US005456269A

United States Patent [19]

Kollasch

[11] Patent Number: 5,456,269

[45] Date of Patent: Oct. 10, 1995

[54] SMOKING APPARATUS

[76] Inventor: Stefan B. Kollasch, 393 Lilley Avenue, North Rockhampton, Queensland 4701, Australia

[21] Appl. No.: 84,194

[22] PCT Filed: Jan. 3, 1992

[86] PCT No.: PCT/AU92/00002

§ 371 Date: Aug. 5, 1993

§ 102(e) Date: Aug. 5, 1993

[87] PCT Pub. No.: WO92/11774

PCT Pub. Date: Jul. 23, 1992

[30] Foreign Application Priority Data

Jan. 4, 1991 [AU] Australia ..... 68678/91

[51] Int. Cl.[6] ..... A24F 1/26

[52] U.S. Cl. ..... 131/330; 131/198.1

[58] Field of Search ..... 131/180, 198.1, 131/202

[56] References Cited

U.S. PATENT DOCUMENTS

| | | | |
|---|---|---|---|
| 2,378,175 | 6/1945 | Benedict | 131/202 |
| 2,601,857 | 7/1952 | Smith . | |
| 4,190,062 | 2/1980 | Paden . | |
| 4,216,786 | 8/1980 | Wright . | |
| 4,223,687 | 9/1980 | Sandeen | 131/180 |
| 4,275,747 | 6/1981 | Miller | 131/198.1 X |
| 4,328,795 | 5/1982 | Cabaniss . | |
| 4,484,590 | 11/1984 | Singh . | |
| 4,524,782 | 6/1985 | Chister | 131/180 |
| 4,527,571 | 7/1985 | Djukic . | |

FOREIGN PATENT DOCUMENTS

| | | |
|---|---|---|
| 60040/90 | 9/1991 | Australia . |
| 68678/91 | 1/1992 | Australia . |
| 801794 | 1/1951 | Germany . |
| 81/02091 | 8/1981 | WIPO . |

*Primary Examiner*—Jennifer Bahr
*Attorney, Agent, or Firm*—Dvorak and Traub

[57] ABSTRACT

Portable smoking apparatus (10) comprises a storage assembly (17) in which tobacco may be stored and from which a charge of tobacco may be selectively fed into a tobacco burning chamber (13). A stem assembly (11) having a mouthpiece (12) is attached to the burning chamber (13) whereby they may be pivoted from a stowed position, at which the mouthpiece (12) is adjacent the storage assembly (17) and the burning chamber (13) is open to the storage assembly, to an operative position at which the burning chamber (13) is exposed for burning and the mouthpiece (12) is remote from the burning chamber and accessible to permit smoke to be inhaled. The stem assembly (11) may be returned to the stowed position whereby the burning chamber (13) moves past an ashing port (32) through which ash from the burning chamber (13) may be discharged.

13 Claims, 5 Drawing Sheets

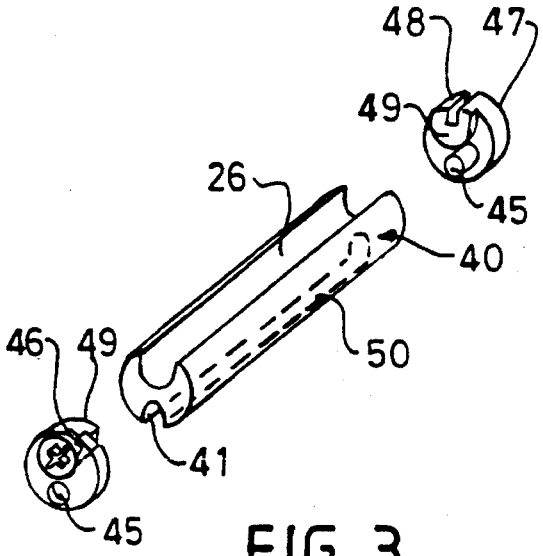
FIG. 3
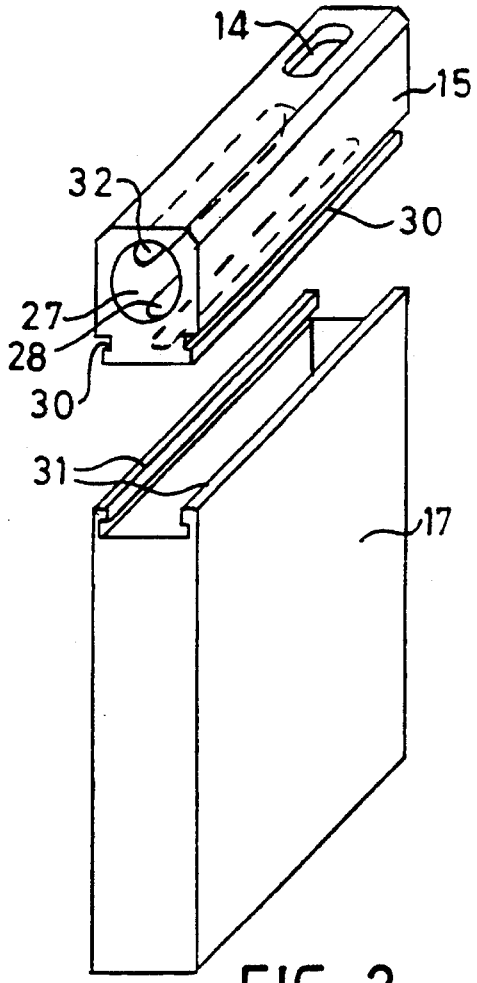
FIG. 2
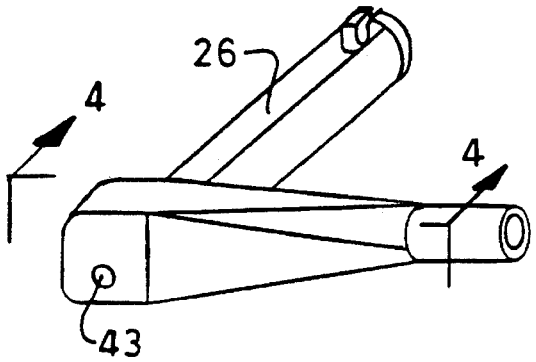
FIG. 4
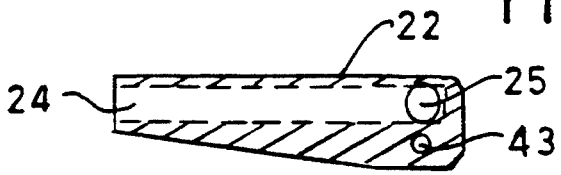
FIG. 5
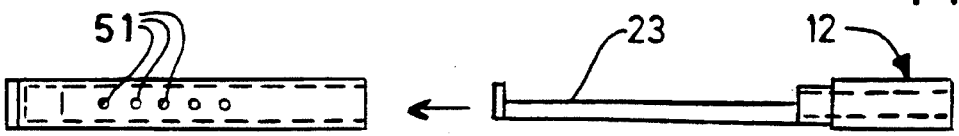

SMOKING APPARATUS

This invention relates to improvements to stoking apparatus. In particular this invention relates to smoking apparatus for smoking tobacco and for illustrative purposes reference will be made to such application hereinafter. Of course the invention is not limited to such use. Accordingly a reference to tobacco herein is to be understood as a reference to any particulate substance to be smoked.

The most common way tobacco is sold is in ready made cigarettes and cigars. Tobacco is also sold in bulk for smoking in pipes or self-rolled cigarettes. Each of these forms of consuming tobacco has limitations for the consumer and in particular the consumption of bulk tobacco is not popular because of the manner in which bulk tobacco is consumed. Assembling a self-rolled cigarette or filling a pipe may create a hazardous situation or detract from the quality of the tobacco if performed with dirty or contaminated hands. Furthermore such action is time consuming and the tobacco is often wasted.

In addition to the above, tobacco is wasted when it continues to burn during protracted periods when the smoke is not inhaled. Such burning may also comprise a potential fire hazard and cause passive smoking. Also, once the cigarette or cigar has been consumed the resultant butt becomes unsightly and a potential hazard to children. With the pipe, the preparation and the need to carry both the pipe and bulk tobacco make pipe smoking relatively unpopular.

The present invention aims to alleviate at least one of the disadvantages set out above and to provide smoking apparatus which will be reliable and efficient in use. Other objects and advantages of this invention will hereinafter become apparent.

With the foregoing and other objects in view, this invention in one aspect resides broadly in portable smoking apparatus including:

- a storage assembly in which tobacco may be stored;
- a burning chamber in which tobacco may be burned;
- feeding means for feeding stored tobacco from the storage assembly into the burning chamber, and
- a stem assembly communicating with the burning chamber and having a mouthpiece through which smoke from tobacco burned in the burning chamber may be inhaled, the stem assembly being moveable from a stowed position adjacent the storage assembly to an operative position at which the mouthpiece is accessible and remote from the burning chamber.

The feeding means may include a plunger which may be biased to force tobacco from the storage assembly into the burning chamber which may be opened to the storage assembly by a suitable gate to permit the required charge of tobacco to enter the burning chamber or closed therefrom to permit the required charge of tobacco to be burnt. For this purpose the tobacco may be supported in the storage assembly in prepared charges adapted to be fed successively into the burning chamber. Alternatively raking means or the like may be supported in the storage assembly to rake tobacco from the storage assembly into the burning chamber.

Preferably however the burning chamber is supported in a chamber body which may be moved to position the chamber in a burning position at which the chamber or a portion thereof is exposed to atmosphere or a loading position at which the chamber communicates with the storage assembly. The chamber body is suitably formed of an insulating material or the burning chamber may be insulated to inhibit heat transfer therefrom. Furthermore the feeding means may be associated with the stem assembly in such manner that movement of the stem assembly actuates the feeding means to feed tobacco from the storage assembly into the burning chamber. For example the stem assembly could be connected to a scraper blade which when pivoted with the stem assembly scrapes a charge of tobacco from the storage assembly into the burning chamber and if desired the scraper blade could constitute a bottom closure for the burning chamber during use. Of course the stem assembly could be arranged independent of the feeding means and could pivot or be a removable plug-in stem assembly if desired.

Preferably the chamber body is supported rotatably within a chamber housing and is rotatable with the stem assembly from a stowed position at which the burning chamber communicates with the storage assembly whereby a charge may be fed into the burning chamber and an operative position at which the burning chamber is exposed to atmosphere and suitably through a port which may restrict the area of burning chamber exposed to atmosphere. The chamber body may also be rotated to align the burning chamber with an ash discharge port which is preferably the same size as the burning chamber so as to facilitate discharge of ash from the burning chamber. Of course the means for restricting the area of the burning chamber exposed to atmosphere may include a removable burning chamber cover which may be removed to facilitate discharge of ash from the burning chamber.

Preferably the storage assembly is adapted to contain the tobacco in a loose packed form such that inversion of the smoking apparatus will gravitationally feed tobacco into the burning chamber. In a preferred form the chamber body is fixed to the stem assembly so that when the latter extends substantially horizontally, the burning chamber opens upwardly. Thus when the stem is rotated to a horizontal position and the storage chamber is inverted, tobacco will fall into the burning chamber. Subsequent rotation of the storage assembly about the chamber body for return to its normal lower position, will expose the burning chamber to atmosphere.

It is preferred that the chamber body be frictionally retained within the chamber housing such that it may be readily withdrawn for cleaning purposes. Of course if desired the burning chamber may be mechanically retained in the chamber housing and suitable cleaning access may be provided to permit the air passage through the stem assembly and the chamber housing to be cleared. For example these passages may be so formed as to enable a conventional pipe cleaner or the like to be passed therethrough in conventional manner.

The stem assembly may include a removable filter and in addition it may include air bleed passages through which fresh air may be introduced into the stem assembly with smoke supplied from the burning chamber. Of course, auxiliary air inlet means may be provided to the burning chamber where necessary to ensure that combustion of the tobacco therein is effective. Such auxiliary air inlets may be arranged for closure or partial closure by a user's finger so that the appropriate blend of smoke and fresh air may be inhaled by the user as desired.

In order that this invention may be more readily understood and put into practical effect, reference will now be made to the accompanying drawings which illustrate a typical embodiment of the present invention and wherein:

FIG. 2 is an exploded view of the three sub-assemblies which form the smoking apparatus of FIG. 1;

FIG. 3 is an exploded view of the chamber body;

FIG. 4 is a sectional view of the stem housing;

FIG. 5 is an exploded view illustrating the stem housing and the mouthpiece and filter support;

Figure 8:
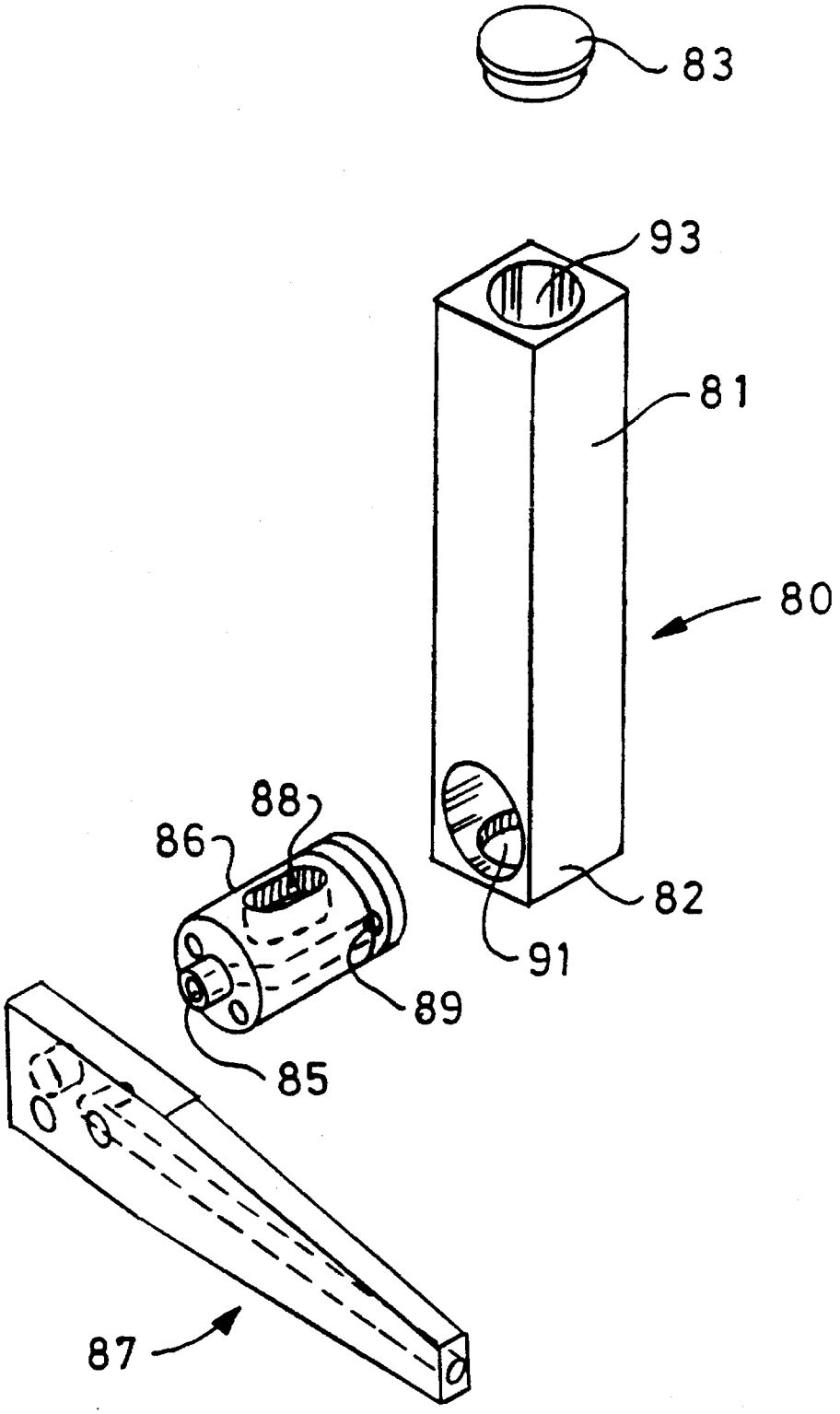
Figure 7A:
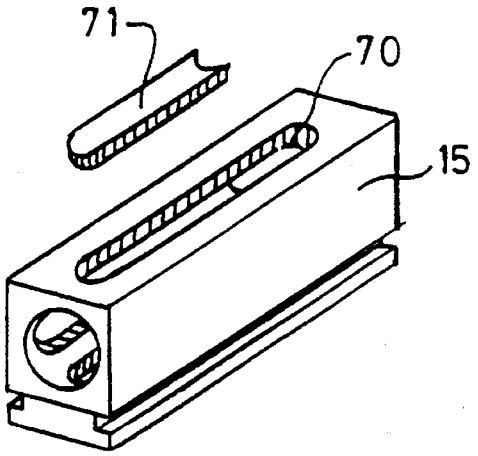
Figure 7B:
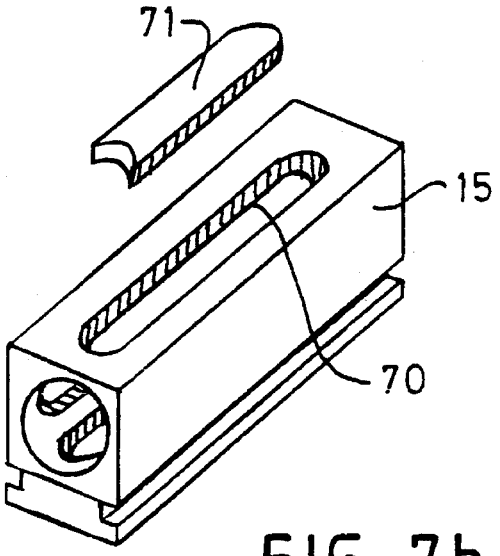
Figure 7C:
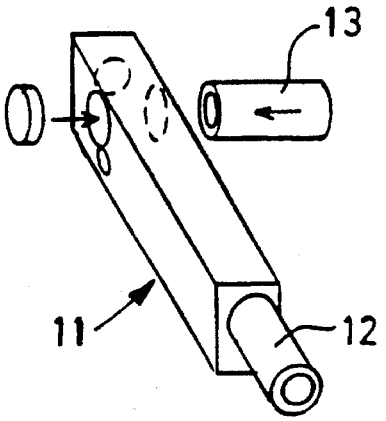
Figure 7D:
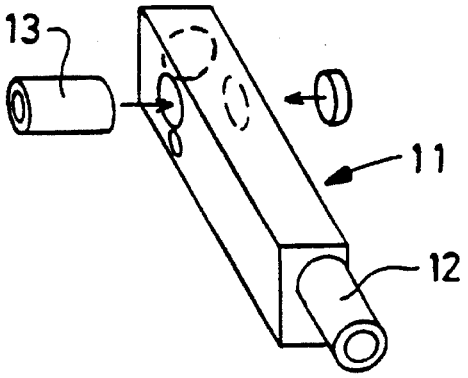

FIGS. 6*a* to 6*d* are a series of diagrammatic exploded views illustrating the operation of the invention;

FIGS. 7*a* to 7*d* illustrate an alternate arrangement for converting the apparatus for right or left hand use, and FIG. 8 is an exploded view of a simplified embodiment of the invention.

As illustrated a smoking apparatus 10 of the present invention has a stem assembly 11 including a mouthpiece 12 through which smoke may be inhaled from a burning chamber 13 exposed to atmosphere through a burning port 14 in the end of a burning chamber housing 15. A tobacco storage assembly 17 is clipped to the burning chamber housing 15 as illustrated at 20 and the housing 15 is pivotable about the burning chamber 13 which is fixed to the stem assembly 11 whereby the latter may be pivoted to a stowed position alongside the end face 16 of the tobacco storage assembly 17.

When the stem assembly 11 is retained in the stowed position alongside the side wall 16 the portable smoking apparatus 10 is of a size similar to a conventional packet of cigarettes whereby it may be conveniently carried for use as required. Suitably the overall dimensions of the smoking apparatus 10 are approximately 15 mm thick, 30–40 mm wide and 80 mm long. It is envisaged that this will provide sufficient stored tobacco for approximately thirty smoking portions.

As illustrated in FIG. 5, the mouthpiece 12 is removably connected to the adjacent stem housing 22 and it includes a supporting bar 23 along which a filter element may be supported to filter smoke drawn through the stem assembly 11. The bar 23 is supported within the bore 24 of the stem housing 22 which communicates through a side passage 25 with the elongate burning chamber 26. The latter extends through the open cylindrical socket 27 in the burning chamber housing 15 so as to communicate at its end distant from the stem assembly 11 with the burning port 14. The open cylindrical socket 27 is also provided with a loading port 28 opposite the burning port 14 and extending substantially the full length of the socket 27. The socket 27 communicates with the interior of the storage assembly 17 when it is clipped thereto. For this purpose, the lower side faces of the burning chamber housing 15 are recessed at 30 to accommodate the longitudinal ribs 31 extending across the upper side walls of the storage assembly whereby the latter may be either slid or clipped onto the burning chamber housing 15. An ashing port 32 extends along one side of the chamber housing 15. Ash may be discharged from the port 32 upon aligning the burning chamber 13 therewith.

The storage assembly may be a refillable storage container or it may be in the form of a cartridge containing a quantity of tobacco and adapted to be discarded when empty.

Referring specifically to FIG. 3, it will be seen that the elongate burning chamber 26 is formed in a cylindrical chamber body 40 which is suitably formed of ceramics or other heat resistant and nonconductive material. The chamber body is provided with a screw slot 41 opposite the burning chamber 26 whereby it may be secured to the stem housing 22 by a suitable screw passing through the retaining aperture 43 provided in the stem housing and through complimentary apertures 45 provided in each end cap 46, 47 associated with the chamber body 40. The remote end cap 47 is provided with an air bleed or lighting slot 48 which is exposed at the opposite open end of the socket 27.

Each end cap includes a shoulder portion 49 which extends into the respective end portion of the elongate burning chamber 26 so as to locate the end caps on the chamber body 40. Furthermore the slot 41 through which the retaining screw passes is also adapted to accommodate a felt wiper which provides the desired degree of frictional restraint and sealing of the chamber body 40 within the socket 27.

Figure 6B:
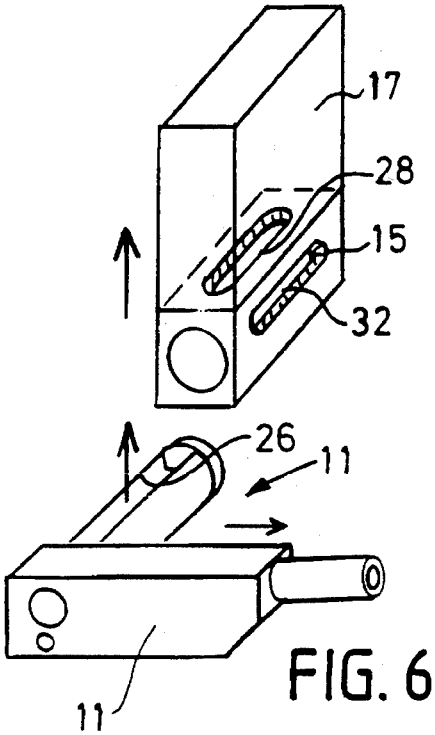
Figure 6A:
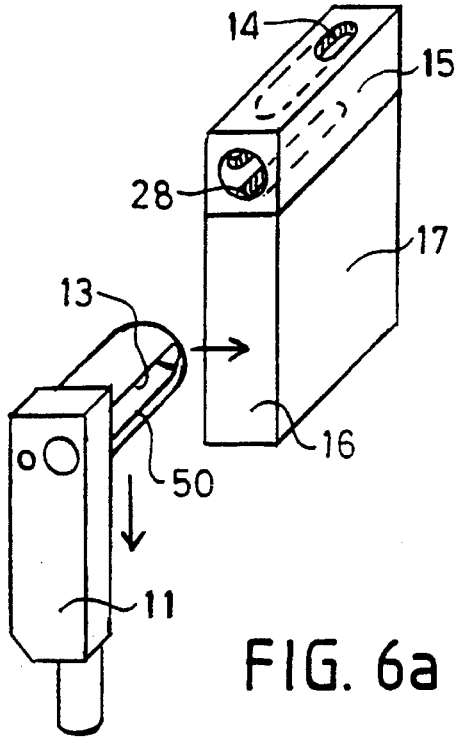

In use, as illustrated in FIG. 6a, tobacco in loose chopped form is stored in the storage assembly 17 which is clipped to the underside of the housing 15 and the stem assembly 11 when not in use is retained in its storage position alongside the end face 16. In this position the cylindrical side wall 50 closes the loading port 28 and thus effectively seals the storage assembly 17.

Figure 6C:
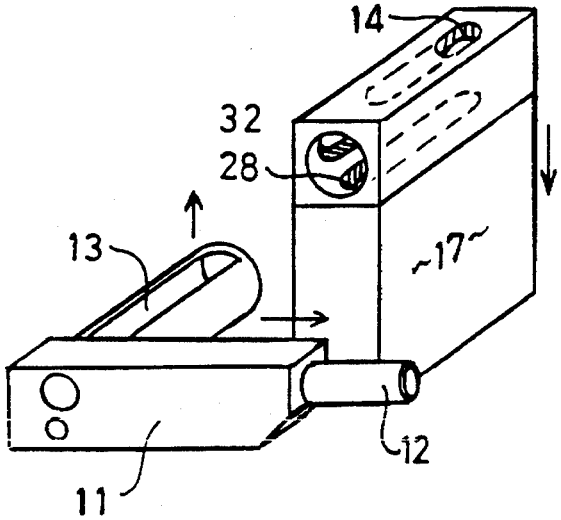

When it is desired to introduce a charge of tobacco into the burning chamber 26 for smoking, the assembly is inverted, as illustrated in FIG. 6*b*, and the stem assembly 11 is rotated to a horizontal position towards the user whereby the burning chamber 26 is aligned with the loading port 28. Tobacco will fall through the loading port 28 into the burning chamber 26. It may be necessary to tap the storage assembly 17 to cause the desired amount of tobacco to settle into the burning chamber 26 whereupon subsequent rotation of the storage assembly 17 to its normal position, while maintaining the stem assembly horizontal, as illustrated in FIG. 6*c*, will align the burning aperture 14 with one end of the burning chamber 26. Thereafter, the tobacco in the burning chamber may be lit to permit smoke to be inhaled through the mouthpiece 12 through the stem assembly 11. Auxiliary air inlets 51 in the stem permit a quantity of fresh air to be inhaled with the smoke.

Figure 1:
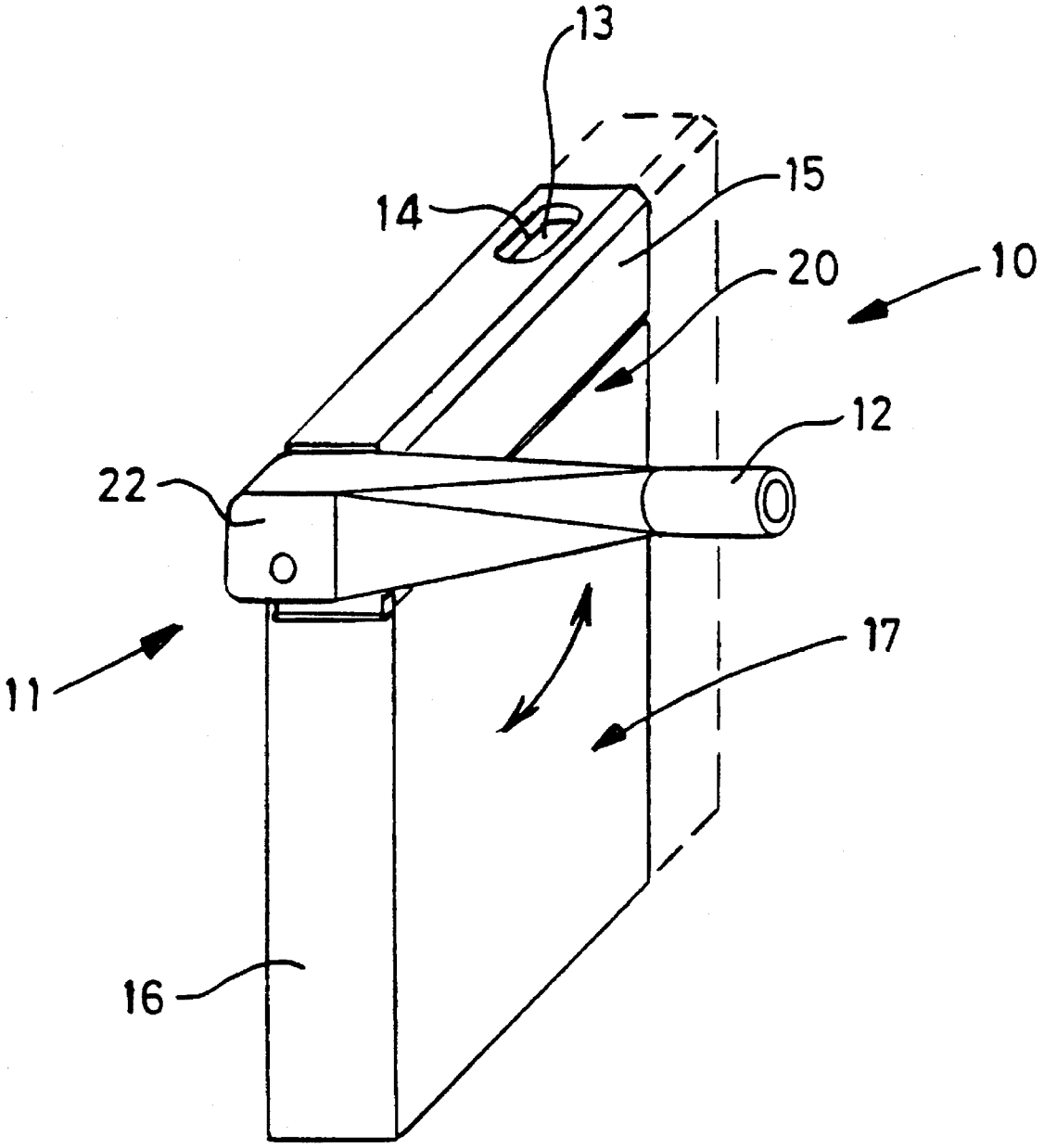
FIG. 1 is a perspective view of one form of the invention illustrated with the stem assembly in its operative position.

If desired, as shown in dotted outline in FIG. 1, a lighter may be clipped to the side of the storage chamber 7 opposite to the stem assembly 11 and be so configured that the flame therefrom extends laterally through the flame slot 48 into the tobacco charge to ignite same. In this manner the lighter is maintained integrally with the smoking apparatus for convenient use.

Figure 6D:
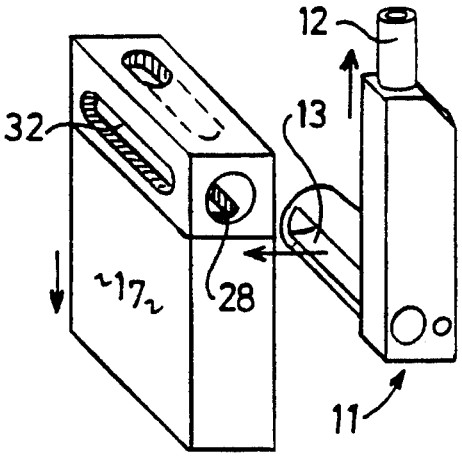

When the tobacco is spent, the ash may be discharged by rotating the stem assembly 11 to an upstanding position, as illustrated in FIG. 6*d*, so as to align the burning chamber 26 with the ashing port 32 thereby providing a large opening for ease of emptying the burning chamber 26.

As described previously the end caps 46 and 47 are interchangeable. This is to enable the stem assembly 11 to be arranged in a left hand or right hand configuration for convenient use by both left and right handed users.

Alternatively, as illustrated collectively in FIGS. 7*a* to 7*d*, the burning chamber housing 15 may be provided with an elongate slot 70 and a blanking piece 71 for selectively closing either end of the slot 70 whereby either open end of the slot 70 may be used as the burning port 14. Furthermore the cylindrical chamber body 73 can be attacher to either side face of the stem 74 and the opposite side plugged to enable the cylindrical chamber body 73 to be inserted from either side of the housing 15 for left or right hand use.

In the embodiment 80 illustrated in FIG. 8 the storage assembly 81 is integral with the burning chamber housing 82. A removable end cap 83 is provided to permit tobacco to be loaded into the storage assembly 81. Furthermore the passage 85 extending through the chamber body 86 and communicating with the stem assembly 87 also extends through the opposite end of the chamber body as shown at 89 to provide an air bleed to the burning chamber 88 which may be blanked by a users finger if desired. For this purpose the socket 80 in the chamber housing 82 is an open ended socket. It includes a burning port 81 and a charging port, not shown, opposite to the burning port and communicating with the interior 83 of the storage assembly 81.

It will of course be realised that the above has been given only by way of illustrative example of the invention and that all such modifications and variations thereto as would be apparent to persons skilled in the art are deemed to fall within the broad scope and ambit of the invention as defined in the appended claims.

I claim:

1. Portable smoking apparatus including:

a housing assembly;

a burning port in the housing assembly;

a storage chamber in the housing assembly in which tobacco may be stored;

a chamber body in said housing assembly and having a burning chamber in which tobacco may be burnt, said chamber body being movable between a loading position, at which the burning chamber communicates with the storage chamber whereby the burning chamber may be loaded with tobacco, and a burning position, at which the burning chamber is exposed to atmosphere through said burning port;

a stem assembly having a mouthpiece communicating with said burning chamber, said stem assembly being movable between a stowed position adjacent said housing assembly and an operative position at which said mouthpiece is accessible and remote from said housing assembly, said stem assembly being coupled to each chamber body such that movement of said stem assembly to its operative position causes said burning chamber to move to said burning position.

2. Portable smoking apparatus as claimed in claim 1, wherein said housing assembly includes a cylindrical socket having an open end through which said chamber body is introduced into said housing assembly.

3. Portable smoking apparatus as claimed in claim 1, wherein said stem assembly is fixed to one end of said chamber body.

4. Portable smoking apparatus as claimed in claim 3, wherein said stem assembly includes a removable mouthpiece and filter assembly.

5. Portable smoking apparatus as claimed in claim 1, wherein said stem assembly includes an auxiliary air inlet means through which fresh air may be introduced to smoke laden air flowing from said burning chamber.

6. Portable smoking apparatus as claimed in claim 1, wherein said housing assembly includes a selectively operable lighter for lighting tobacco exposed to said burning port.

7. Portable smoking apparatus as claimed in claim 1, wherein said burning port is small so as to expose only a portion of said burning chamber to atmosphere.

8. Portable smoking apparatus as claimed in claim 1, wherein said housing assembly is provided with an ash discharge port and wherein said burning chamber may be selectively aligned with said discharge port.

9. Portable smoking apparatus as claimed in claim 1, wherein a portion of said housing assembly including said chamber body is detachable from a portion of said housing assembly including said storage chamber.

10. Portable smoking apparatus including:

a housing assembly;

a burning port in the housing assembly;

a storage chamber in the housing assembly in which tobacco may tic stored;

a chamber body in said housing assembly and having a burning chamber in which tobacco may be burnt, said chamber body being movable between a loading position, at which the burning chamber communicates with the storage chamber whereby the burning chamber may be loaded with tobacco, and a burning position, at which the burning chamber is exposed to atmosphere through said combustion port;

a stem assembly having a mouthpiece communicating with said burning chamber, said stem assembly being movable between a stowed position adjacent said housing assembly and an operative position at which said mouthpiece is accessible and remote from said housing assembly, said stem assembly being coupled to said chamber body such that movement of said stem assembly to its operative position causes said burning chamber to move to said burning position; and said burning port being relatively small so as to expose only a portion of said burning chamber to atmosphere.

11. Portable smoking apparatus as claimed in claim 10, wherein said housing assembly includes a cylindrical socket having an open end through which said chamber body is introduced into said housing assembly; and said burning port opens to atmosphere in the top of said socket remote from said open end and the chamber body selectively communicates with the storage chamber through a port in the bottom of said socket.

12. Portable smoking apparatus as claimed in claim 10, wherein said stem assembly is fixed to one end of said chamber body and includes a removable mouthpiece and filter assembly.

13. Portable smoking apparatus as claimed in claim 10, wherein said housing assembly includes a selectively operable lighter for lighting tobacco exposed in said burning port.

* * * * *